US011539147B2

(12) United States Patent
Tseng

(10) Patent No.: US 11,539,147 B2
(45) Date of Patent: Dec. 27, 2022

(54) ELECTRICAL CONDUCTOR CONNECTOR

(71) Applicant: HEAVY POWER CO., LTD., New Taipei (TW)

(72) Inventor: Chieg-Li Tseng, New Taipei (TW)

(73) Assignee: HEAVY POWER CO., LTD., New Taipei (TW)

( * ) Notice: Subject to any disclaimer, the term of this patent is extended or adjusted under 35 U.S.C. 154(b) by 0 days.

(21) Appl. No.: 17/363,787

(22) Filed: Jun. 30, 2021

(65) Prior Publication Data

US 2022/0037809 A1 Feb. 3, 2022

(30) Foreign Application Priority Data

Jul. 29, 2020 (TW) ..... 109125664

(51) Int. Cl.
*H01R 4/48* (2006.01)
*H01R 11/09* (2006.01)

(52) U.S. Cl.
CPC ..... *H01R 4/4836* (2013.01); *H01R 4/4845* (2013.01); *H01R 11/09* (2013.01)

(58) Field of Classification Search
CPC ..... H01R 4/4836; H01R 11/09; H01R 31/08
See application file for complete search history.

(56) References Cited

U.S. PATENT DOCUMENTS 9,437,940 B1 * 9/2016 Rao ..... H01R 13/502
9,466,895 B2 * 10/2016 Köllmann ..... H01R 4/4836
10,498,050 B1 * 12/2019 Liang ..... H01R 4/4845

FOREIGN PATENT DOCUMENTS

CN 104995799 B 11/2017
EP 3038212 A1 * 6/2016 ..... H01R 4/48

* cited by examiner

*Primary Examiner* — Briggitte R. Hammond
(74) *Attorney, Agent, or Firm* — Rabin & Berdo, P.C.

(57) ABSTRACT

The present invention relates to an electrical conductor connector, comprises: an insulating body, a contact member and an actuation lever. A plurality of inserting openings are provided in the insulating body. The contact member comprises a busbar and a wire connection clamp. The actuation lever comprises an actuation portion for cooperating with the wire connection clamp and a flip portion, wherein the actuation portion is provided with a cam, a stop wall is provided inside the insulating body for contacting the cam. When the flip portion is flipped, the actuation lever swings and moves jointly through the contour of the cam and a contact surface of the stop wall, so a relative displacement is generated between the insulating body and the actuation lever. A contact point is generated between the surface of wire connection clamp and the actuation portion, and the position of the contact point will be changed continuously.

9 Claims, 14 Drawing Sheets

ELECTRICAL CONDUCTOR CONNECTOR

FIELD OF THE INVENTION

The invention relates to an electrical conductor connector, in particular to an electrical conductor connector for clamping or releasing a lead wire by operating a lever.

BACKGROUND OF THE INVENTION

In the current market, among electronic parts used to connect multiple lead wires, there is a kind of wire connection clamp that releases or clamps wires by flipping a lever on them; for example, such a wire connection clamp is disclosed in the China invention patent No. CN104995799B.

In the case, a manipulator 4 is rotated against an insulating material housing 2 on an imaginary axis D by flipping the manipulator 4 so that the manipulator 4 is rotated in a clockwise direction through the support groove 15 in the insulating material housing 2 and the circularly curved section 31 of a rotary support area 14 on the manipulator 4 in FIGS. 3 and 4 of the case, and in the process of rotation the manipulator section 16 on a rotary support area 14 drives the clamping edge 20 of the clamping spring 17 to change its state.

In this way, different areas of the surface of the rotary support area 14 are used directly as manipulators 4 to rotate the manipulator and drive the clamping spring 17. Therefore, the shape of the rotation support area 14 shows that this type of wire connection clamp may rotate the manipulator 4 in the release status as long as the manipulator 4 is subjected to a force sufficient to make the manipulator 4 resist the frictional force between the manipulator 4 and the support groove 15, and it will maintain the angle after rotation. Therefore, after several collisions and rotating to a specific angle, it will directly return from the release status to the close status by itself.

SUMMARY OF THE INVENTION

The main purpose of the present invention is to provide an electrical conductor connector with a cam type lever, and the lever can be moved and swung to change the status of a wire connection clamp, so as lead wire can be inserted into the electrical conductor connector in a release status and the lead wires can be electrically connected to each other in a clamp status.

A secondary purpose of the present invention is to provide an electrical conductor connector, in which a wire connection clamp can be changed from a release status for inserting the lead wire to a clamp status for holding the lead wire by rotating the lever, and the lever can automatically return to the original position within a certain degree of rotation.

In order to achieve the above purpose, the electrical conductor connector of present invention comprises an insulating body, a contact member, and an actuation lever. The insulating body is formed with a plurality of inserting openings along an inserting direction, and a mounting space is formed inside the insulating body for connecting the inserting openings, so that a plurality of lead wires may be inserted into the mounting space along the inserting openings respectively.

The contact member is located in the mounting space and is constructed with multiple terminal contacts adjacent to each other. The contact member comprises a busbar forming all terminal contacts and a wire connection clamp pressing the lead wire against the busbar.

The actuation lever is movably assembled to the insulating body and has an actuation portion cooperating the wire connection clamp and a flip portion forming a grip area. The actuation portion has two operation boards symmetrically arranged to form a spacing area. The edge contour of operation board is constructed with a pressing section against the wire connection clamp.

Wherein the operation board is provided with a cam, the mounting space is formed with a stop wall for contacting the cam. When the flip portion is flipped, the wire connection clamp is changed from a clamp status capable of holding the lead wire to a release status for the lead wire to enter the inserting opening. The actuation lever is simultaneously swung and moved along at least one contact surface of the stop wall by the contour of the cam, a relative displacement is generated between the insulating body and the actuation lever, and a contact point between the wire connection clamp and the pressing section will continuously change position on the surface of the wire connection clamp.

With respect to the structure of the insulating body, in a preferred embodiment, the stop wall comprises a first contact surface and a second contact surface that is adjacent to the first contact surface. A force is generated by the wire connection clamp to push the cam, so that the cam keeps in contact with both the first contact surface and the second contact surface. When the flip portion is flipped, the actuation lever simultaneously swung and moved to keep the cam contacting the first contact surface and the second contact surface.

With respect to the structure of the actuation lever, in a preferred embodiment, the pressing section comprises a first plane, a second plane, and a curve surface located between the first plane and the second plane. A farthest distance is formed between the surface of cam and the of curve surface of pressing section.

In this embodiment, when the electrical conductor connector changes from the clamp status to the release status, the contact point on the pressing section moves from the first plane, through the curve surface, to the second plane. The cam has a center point, a long axis and a short axis, the long axis and the short axis pass through the center point. The surface of the second plane is parallel to the surface of the wire connection clamp in the release status. The long axis is perpendicular to the stop wall.

In another embodiment, the cam of the actuation lever has a center point, a long axis and a short axis, the long axis and the short axis pass through the center point. When a farthest distance is formed between the contact point and the surface of the cam, an angle is formed between the long axis and the stop wall.

The wire connection clamp may be swung for clamping the lead wire. When the electrical conductor connector is changed from the clamp status to the release status, the distance between the center point and the stop wall continues to increase, so that the wire connection clamp is push by the pressing section to increase a swing distance of the wire connection clamp.

A first vertical distance is formed between the center point and the stop wall. A second vertical distance is formed between the center point and the contact point. When the electrical conductor connector changes from the clamp status to the release status, the first vertical distance continues to increase; the second vertical distance first gradually increases and then gradually decreases after the actuation lever exceeds a rotation angle.

In a preferred embodiment, the wire connection clamp comprises a first clamping arm, a positioning wall, an elastic arm, a second clamping arm and a limit arm, the busbar is attached with the first clamping arm, the positioning wall is provided with at least one perforation for the lead wire entry and is connected to the first clamping arm, the elastic arm is connected to the positioning wall and a spacing is formed between the elastic arm and the first clamping arm, the second clamping arm is connected to the elastic arm, the limit arm is connected between the first clamping arm and the elastic arm to limit the length of the space without increase.

In more detail, in this embodiment, the second clamping arm comprises a compression portion, a first line section and a second line section, the first line section is extended with the compression portion toward the first clamping arm, the second line section is extended with the first line section, and the opposite sides of the compression portion are provided with a lug for aligning the position of the pressing section.

The elastic arm comprises a first curved section and a second curved section extending from the first curved section, the second curved section is folded for connecting the second clamping arm, so as the second clamping arm may thus swing through the elastic arm.

The present invention is characterized in that a torque is changed by the variable length of cam to cooperate with the curve surface of pressing section, so that two ends of the wire connection clamp close to or far from each other; wherein the actuation lever is capable of being returned to the original position by the pressing section and the elastic arm before rotating to a certain angle.

DETAILED DESCRIPTION OF THE PREFERRED EMBODIMENTS

Hereinafter, preferred embodiments of the present invention are cited, and further detailed description is given as follows in conjunction with the drawings.

Figure 1:
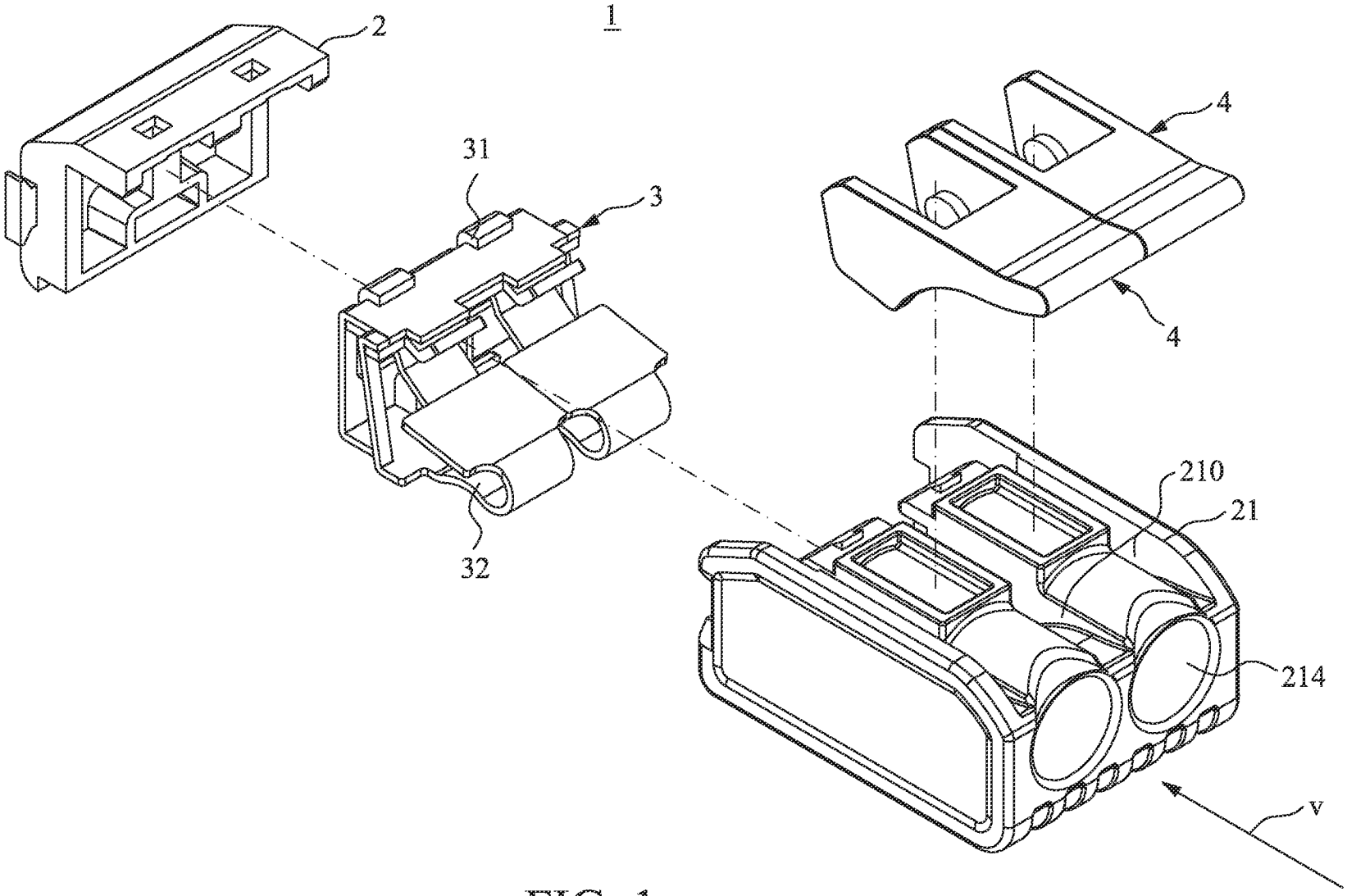
FIG. 1 is an exploded schematic view of an electrical conductor connector of the present invention in a preferred embodiment.

Referring to FIG. 1, the electrical conductor connector 1 of the present invention, in a preferred embodiment, comprises an insulating body 2 formed by a first body 21 and a second body 22, a contact member 3 for clamping multiple lead wires and electrically connecting the lead wires to each other, and two actuation levers 4 for operating the contact member 3 to change the state of the contact member 3. In use, the electrical conductor connector 1 can be changed from a clamp status S1 (see FIG. 5A) in which the lead wire is fixed to a release status S2 (see FIG. 5D for details) in which the lead wire is released by flipping the lever 4.

Figure 2A:
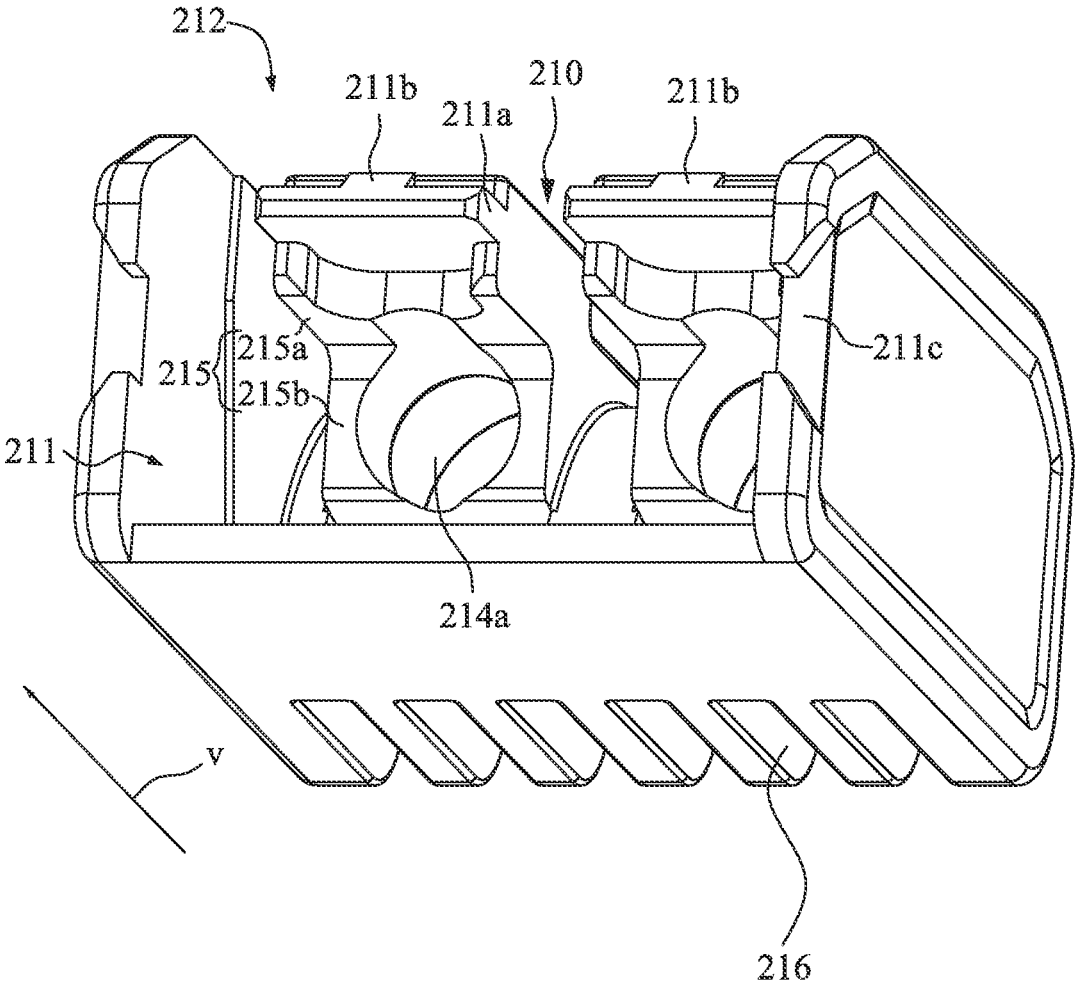
FIG. 2A is a three-dimensional schematic view of a first body of the embodiment of FIG. 1.
Figure 2B:
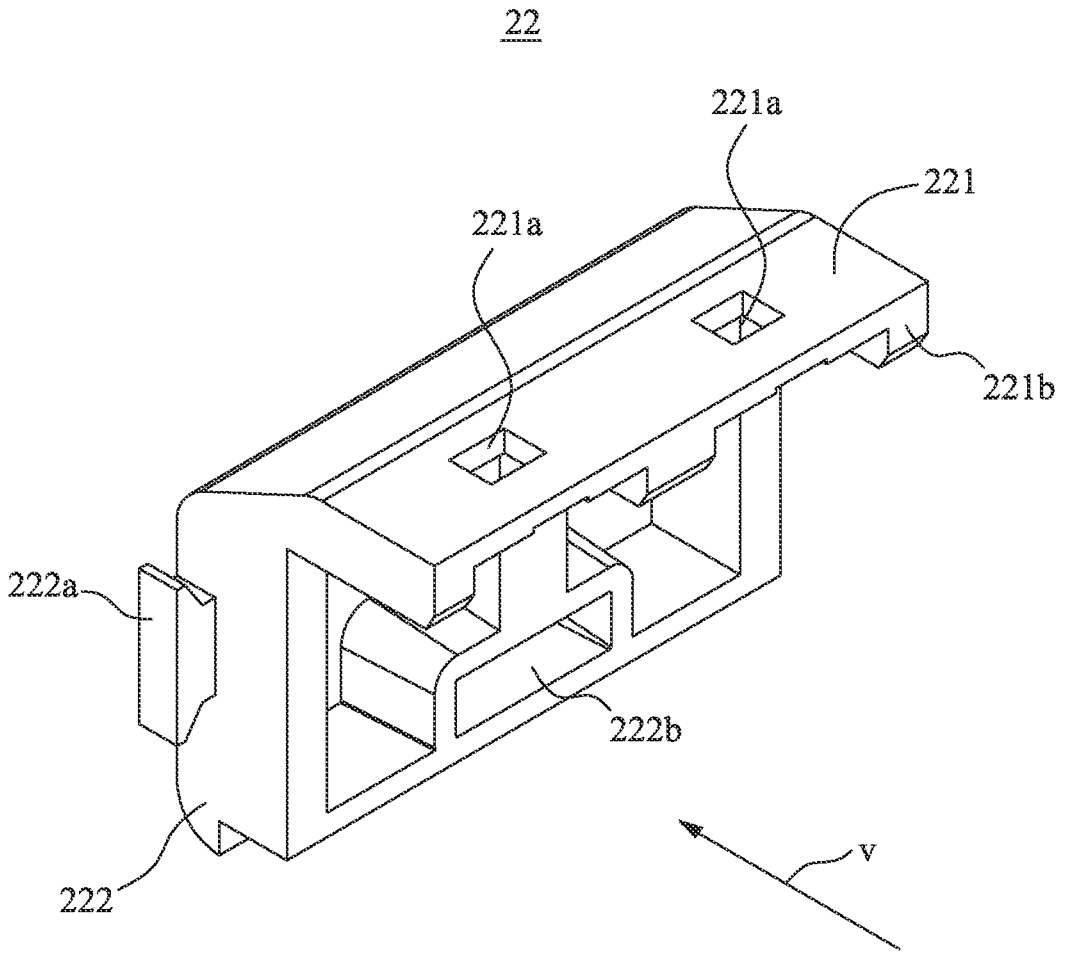
FIG. 2B is a three-dimensional schematic view of a second body of the embodiment of FIG. 1.
Figure 2C:
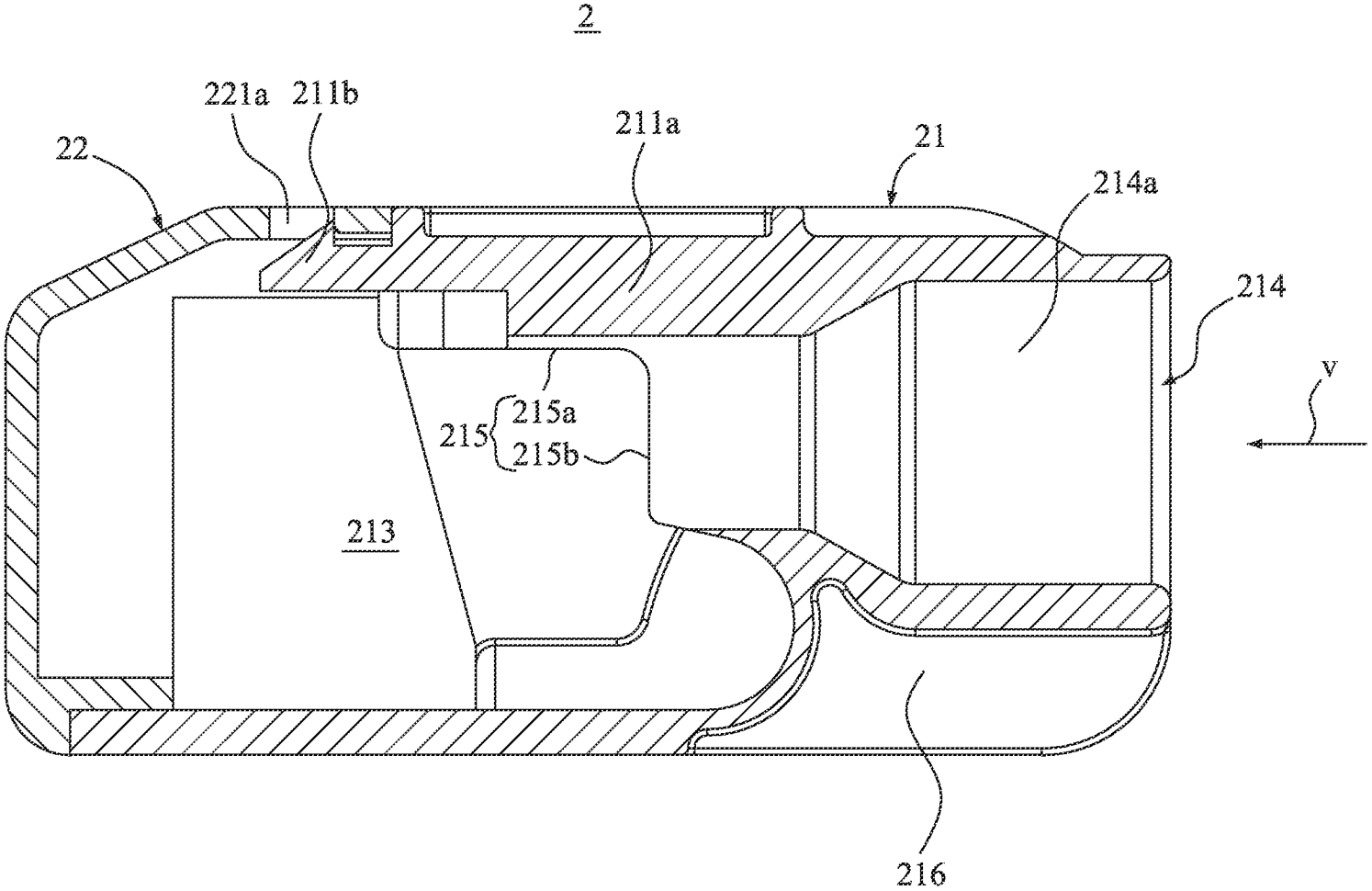
FIG. 2C shows a schematic side section of the insulating body.

Regarding the design of the insulating body 2, first of all, please refer to FIG. 1 to FIG. 2C, the insulating body 2 comprises the first body 21 and the second body 22. The first body 21 is formed with a storage slot 211. The storage slot 211 has a slotted opening 212. The second body 22 is assembled with the storage slot 211 for covering the slotted opening 212. The first body 21 and the second body 22 collectively form a mounting space 213 inside the insulating body 2 through closing the slotted opening 212, so that the contact member 3 can be accommodated in the interior of the insulating body 2.

As shown in the figure, the first body 21 has a plurality of inserting openings 214 formed on a side surface away from the storage slot 211, and the inserting openings 214 are communicated with the storage slot 211 along an inserting direction V. The inserting opening 214 has a guided path 214*a* for tapering along the inserting direction (V). An insulation material 231 of the lead wire 23 is collected through the larger radius of the guided path 214*a*, and a conductor in the center of the lead wire 23 enters the mounting space 213 (see FIG. 5E).

In order to allow the actuation lever 4 to fit with the first body 21, the storage slot 211 is provided with a plurality of channels 210 adjacent to a wall 211*a* for accommodating the actuation lever 4, and one side of the wall 211*a* is provided with a block 211*b* for fixing the second body 22. And in order that the second body 22 may only be assembled with the first body 21 from the opposite direction of inserting direction V, the first body 21 is provided with two trapezoid-shaped slots 211*c* on the opposite edges of the storage slot 211.

The bottom of wall 211*a* in the storage slot 211 is formed with a stop wall 215 for contacting the actuation lever 4, and the stop wall 215 comprises a first contact surface 215*a* connecting with the wall 211*a* and a second contact surface 215*b* adjacent to the storage slot 211 (perpendicular in this embodiment).

In addition, for the convenience of holding the electrical conductor connector 1, one side of the first body 21 is provided with multiple anti-slip grooves 216 near the inserting opening 214.

In this embodiment, in order to cover the slotted opening 212, the second body 22 is an L-shaped cover, and the L-shaped cover has a first wall 221 parallel to the inserting direction V and a second wall 222 perpendicular to the inserting direction V. The first wall 221 is provided with a recess 221*a* aligning the position of the block 211*b* for fitting the wall 211*a*. In addition, in order to limit the rotation angle of the actuation lever 4, one side of the first wall 221 is formed with a block surface 221*b* that faces the first body 21, and the actuation lever 4 is blocked by the block surface 221*b* for limiting the rotation angle of the actuation lever 4.

The opposite sided of second wall 222 are provided with a wedge blocks 222*a* that correspond to the trapezoid-shaped slot 211*c*. In addition, the second wall 222 has a inspection hole 222*b* away from the first wall 221, so that a detector can be inserted into the mounting space 213 to contact the contact member 3 to determine whether the lead wires 23 connected in the electrical conductor connector 1 are conductive.

Referring to FIG. 1, FIG. 3A to FIG. 3D, the contact member 3 is constructed with multiple terminal contacts adjacent to each other. The contact member 3 comprises a busbar 31 forming all the terminal contacts and a plurality of wire connection clamps 32 for pressing the lead wires 23 individually against the busbar 31.

Figure 3A:
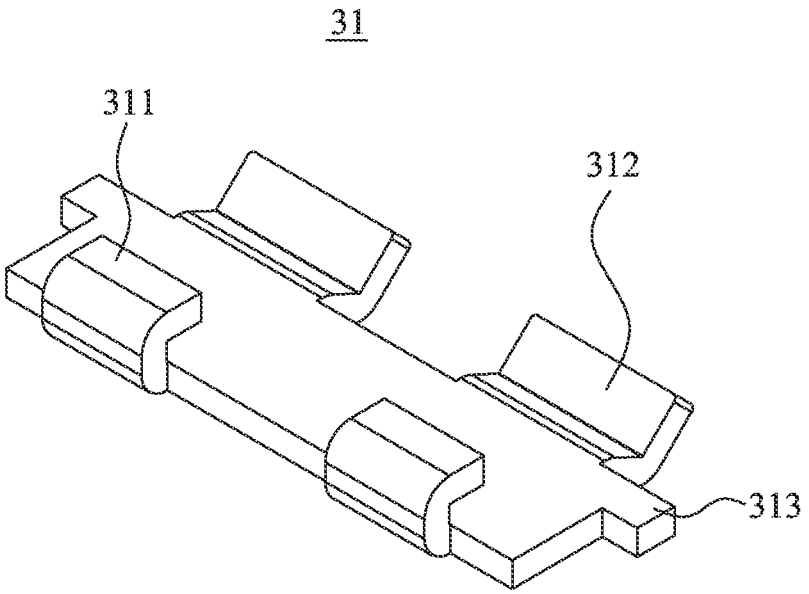
FIG. 3A is a three-dimensional schematic view of a busbar of the embodiment of FIG. 1.
Figure 3B:
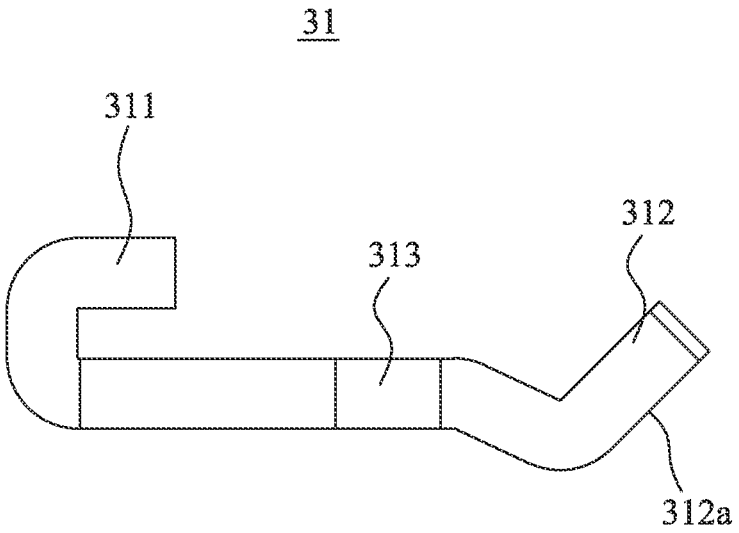
FIG. 3B is a schematic side view of the busbar.

As shown in FIG. 1, FIG. 3A, and FIG. 3B, the busbar 31 is formed with an inverted hook 311 at one end of latitudinal direction and a curved section 312 at the other end of latitudinal direction. The busbar 31 is provided with connection bumps 313 at opposite ends of longitudinal direction. The inverted hook 311 of the busbar 31 is used to assemble with the wire connection clamp 32. The curved section 312 is formed with an inclined plane 312*a* that away from the inverted hook.

Figure 3C:
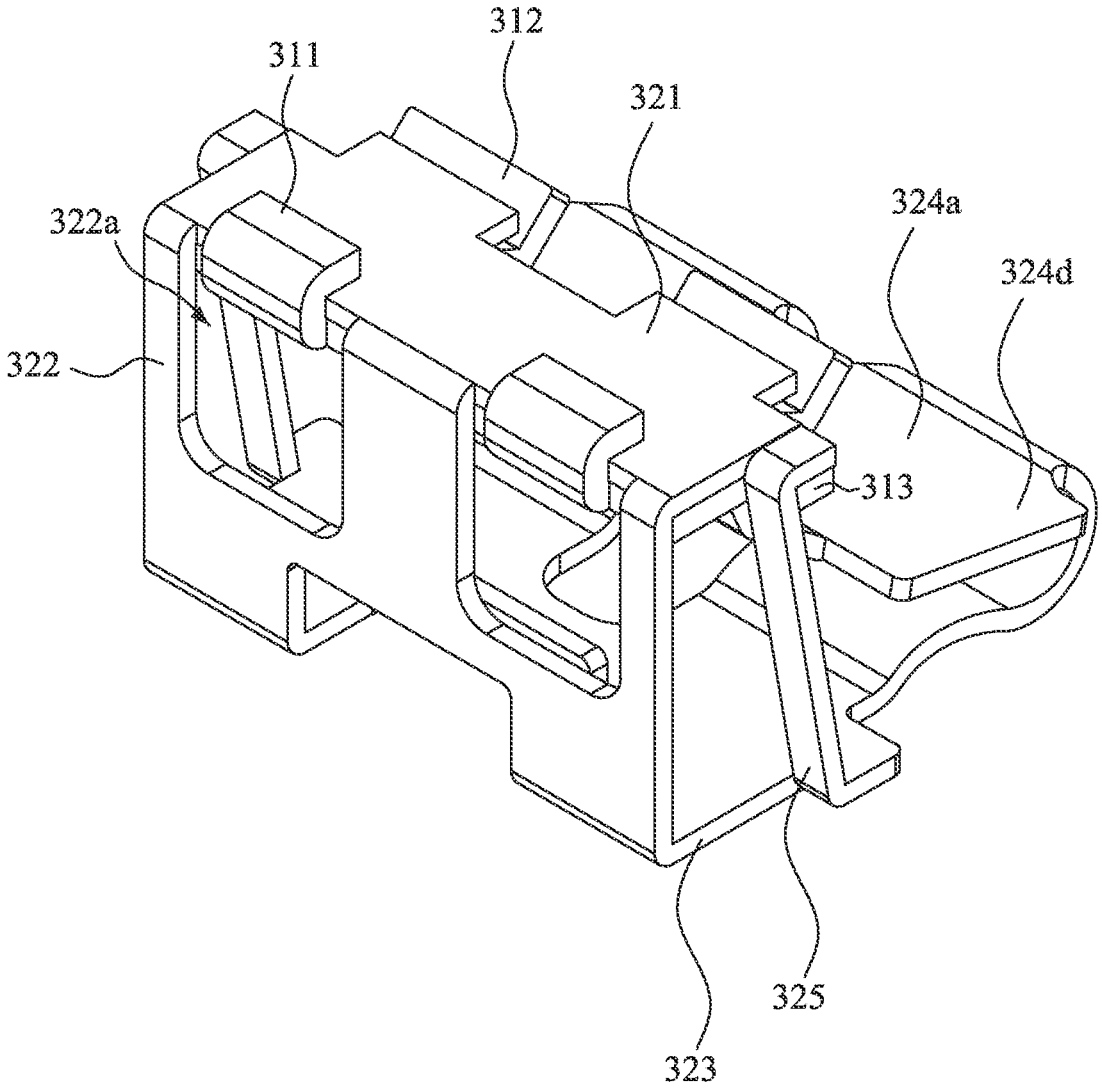
FIG. 3C is a three-dimensional schematic view of a contact member of the embodiment of FIG. 1.
Figure 3D:
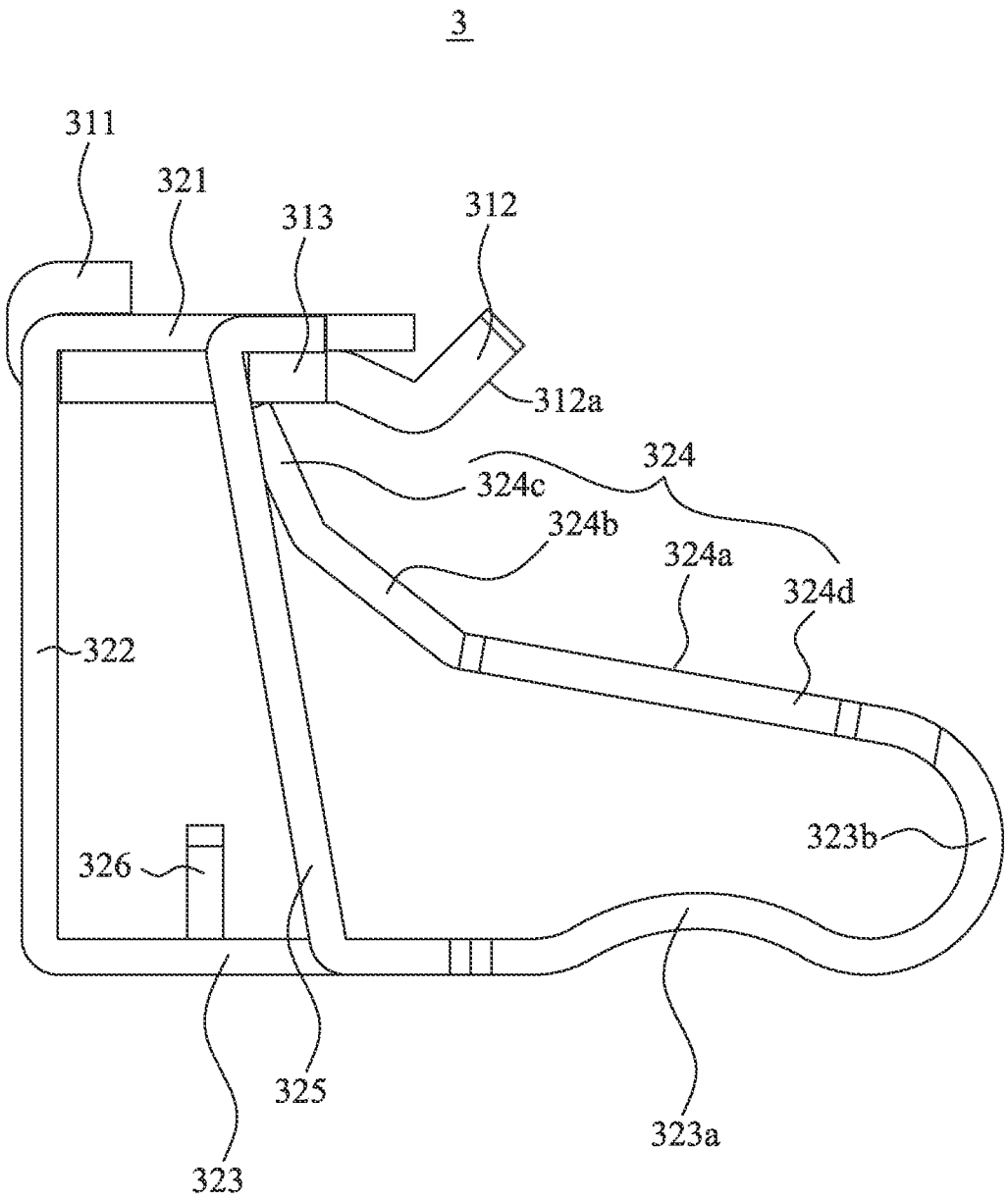
FIG. 3D is a schematic side view of the contact member.
Figure 4A:
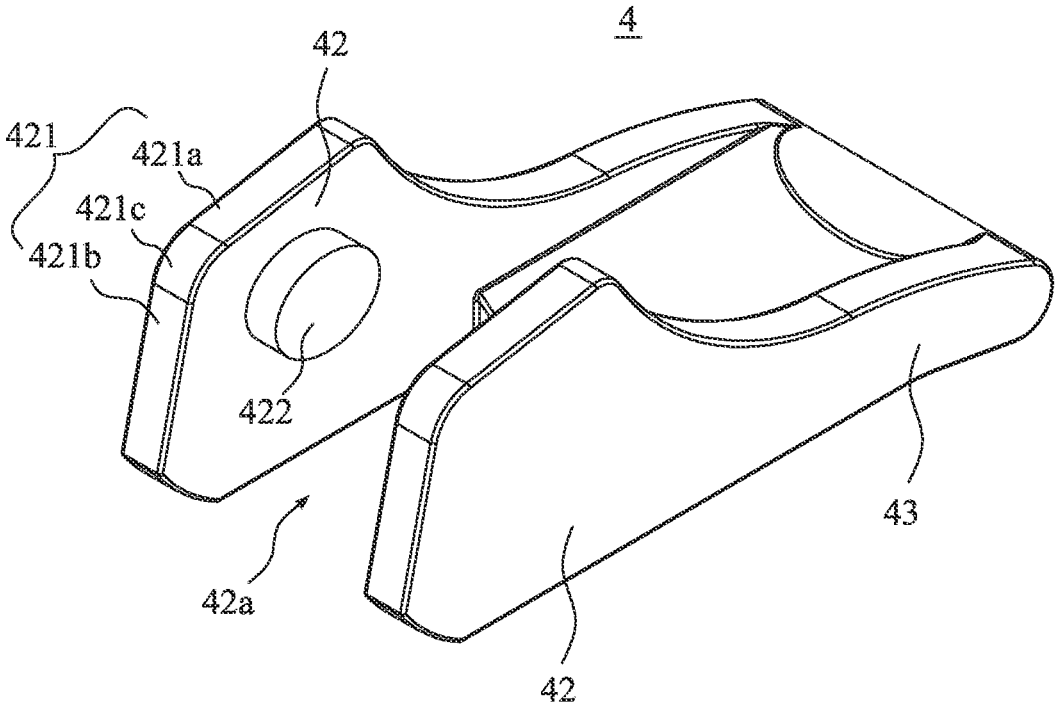
FIG. 4A is a three-dimensional schematic view of an actuation lever of the embodiment of FIG. 1.
Figure 4B:
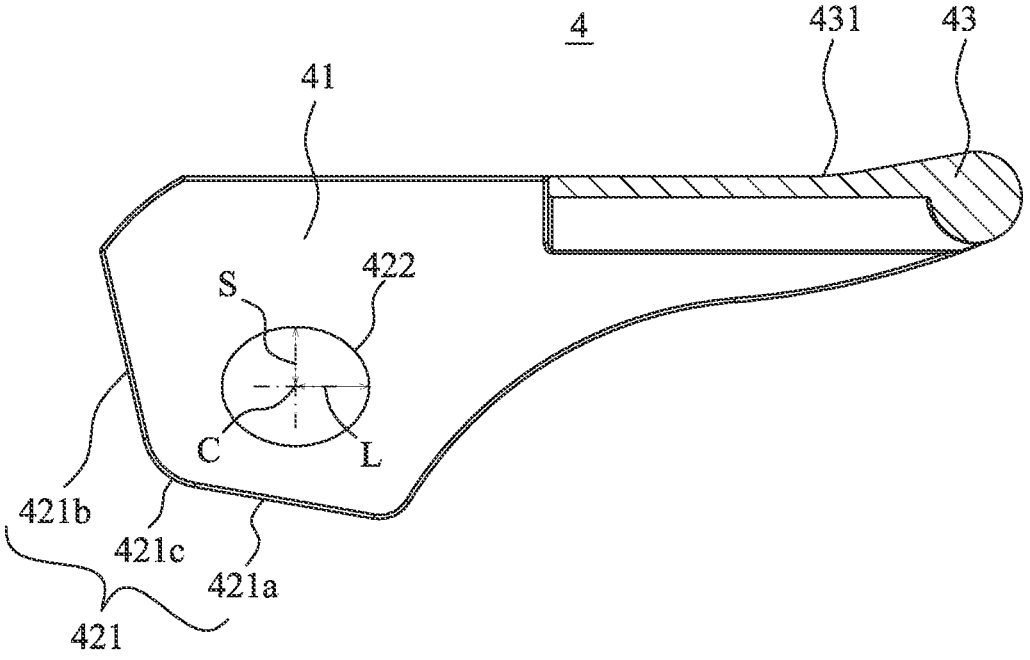
FIG. 4B is a sectional side view of the actuation lever.

As shown in FIG. 1, FIG. 3C, and FIG. 3D, the wire connection clamp 32 comprises a first clamping arm 321 for assembling the busbar 31, a positioning wall 322 vertically connected to the first clamping arm 321 and provided with a perforation 322*a* for the lead wire 23 to enter, an elastic arm 323 vertically connected to the positioning wall 322 and spaced apart from the first clamping arm 321, and a second clamping arm 324 connected to the elastic arm 323 and extending toward the first clamping arm 321.

The second clamping arm 324 may be swung by the elastic arm 323 relative to the first clamping arm 321 and the positioning wall 322, the second clamping arm 324 and the first clamping arm 321 cooperatively clamp the lead wire that pierced on the perforation 322*a*. To increase the strength of the second clamping arm 324 in holding the lead wire 23, the second clamping arm 324 comprises a compression portion 324*a* for cooperating with the actuation lever 4, a first line section 324*b* extending from the compression portion 324*a* and a second line section 324*c* extending from the first line section 324*b*. The first line section 324*b* is deflected toward the first clamping arm 321, and the second line section 324*c* is deflected relative to the first line section 324*b*. The structural strength of the second clamping arm 324 will be increased by multi-bending way, so that the deformation of the wire connection clamp 32 is concentrated on the elastic arm 323. In order to prevent the actuation lever 4 from interfering with the lead wire 23 and to provide an even force for the actuation lever 4 to push against the second clamping arm 324, a lug 324*d* corresponding to the position of a pressing section 421 on the actuation lever 4 is formed on each side of the compression portion 324*a*.

In addition, in order to allow the elastic arm 323 to be deformed at a specific position so that the second clamping arm 324 may be swung by allowing the actuation lever 4 to act, the elastic arm 323 comprises a first curved section 323*a* extending from the positioning wall 322 and a second curved section 323*b* extending from the first curved section 323*a*; the second curved section 323*b* is folded for connecting the second clamping arm 324, so that the second clamping arm 324 extends toward the first clamping arm 321.

When the busbar 31 is connected to the wire connection clamp 32, the inverted hook 311 of the busbar 31 is mounted by the perforation 322*a* on the side of the first clamping arm 321 near the positioning wall 322. The curved section 312 projects toward the second clamping arm 324 to provide easier contact to the lead wire 23 that passes through the perforation 322*a*. The inclined plane 312*a* is used to guide the lead wire 23 into the perforation 322*a* along the inserting direction V (see FIG. 5E).

When the contact member 3 clamps the lead wire 23, the volume of the lead wire 23 causes the first clamping arm 321 and the second clamping arm 324 to be separated from each other. In addition to causing a deformation between the second clamping arm 324 and the elastic arm 323, an angle between two of the first clamping arm 321, the elastic arm 323 and the positioning 322 will probably be changed. Therefore, in order to concentrate the deformation on the elastic arm 323 to increase the force of clamping the lead wire 23, the contact member 3 also has a limit arm 325 that limits the relative position between the first clamping arm 321, the positioning wall 322 and the elastic arm 323. One end of the limit arm 325 is connected to the elastic arm 323 and the other end of the limit arm 325 is positioned at the connection bump 313 of the busbar 31.

In addition, to determine whether the lead wire 23 is electrically connected to the contact member 3, a conductive board 326 is provided on the elastic arm 323 at a location corresponding to the inspection hole 222*b*, so as the detector can be inserted into the inspection hole 222*b* for contacting the contact member 3.

Referring to FIG. 4A, FIG. 4B, and FIG. 5A to FIG. 5D, the actuation lever 4 has an actuation portion 41 cooperating with the wire connection clamp 32 and a flip portion 43 forming a grip area 431. The actuation portion 41 has two operation boards 42 symmetrically arranged to form a spacing area 42*a*. The edge contour of the operation board 42 is constructed with a pressing section 421 against the wire connection clamp 32.

In order to allow the actuation lever 4 to swing against the insulating body 2, the operation board 42 is provided with a cam 422 that shows an oval-shape in the spacing area 42*a*. The operation board 42 is positioned in the channel 210 and the cam 422 is contacted with the stop wall 215. Wherein, the cam 422 has a center point C, a long axis L and a short axis S, the long axis L and the short axis S are passing through the center point C. An action point P2 is formed between the cam 422 and the first contact surface 215*a* of the stop wall 215.

For the detailed shape of the pressing section 421, in this embodiment, the pressing section 421 comprises a first plane 421*a*, a second plane 421*b*, and a curve surface 421*c* located between the first plane 421*a* and the second plane 421*b*. A farthest point on the surface of the pressing section 421 from the surface of the cam 422 is located on the curve surface 421*c* (shown as FIG. 4B).

Figure 5A:
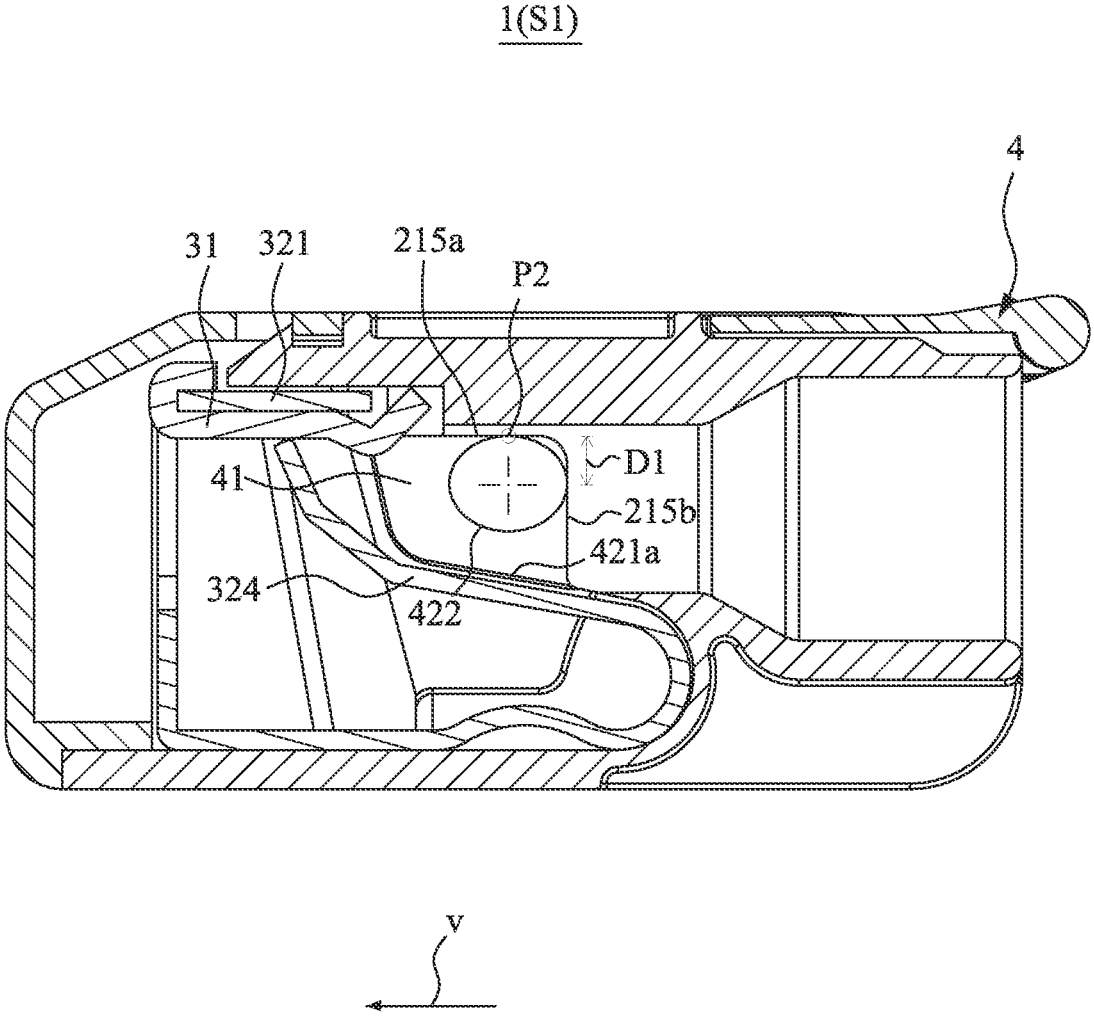
FIG. 5A shows a schematic cross-section of the electrical conductor connector in an clamp state.
Figure 5B:
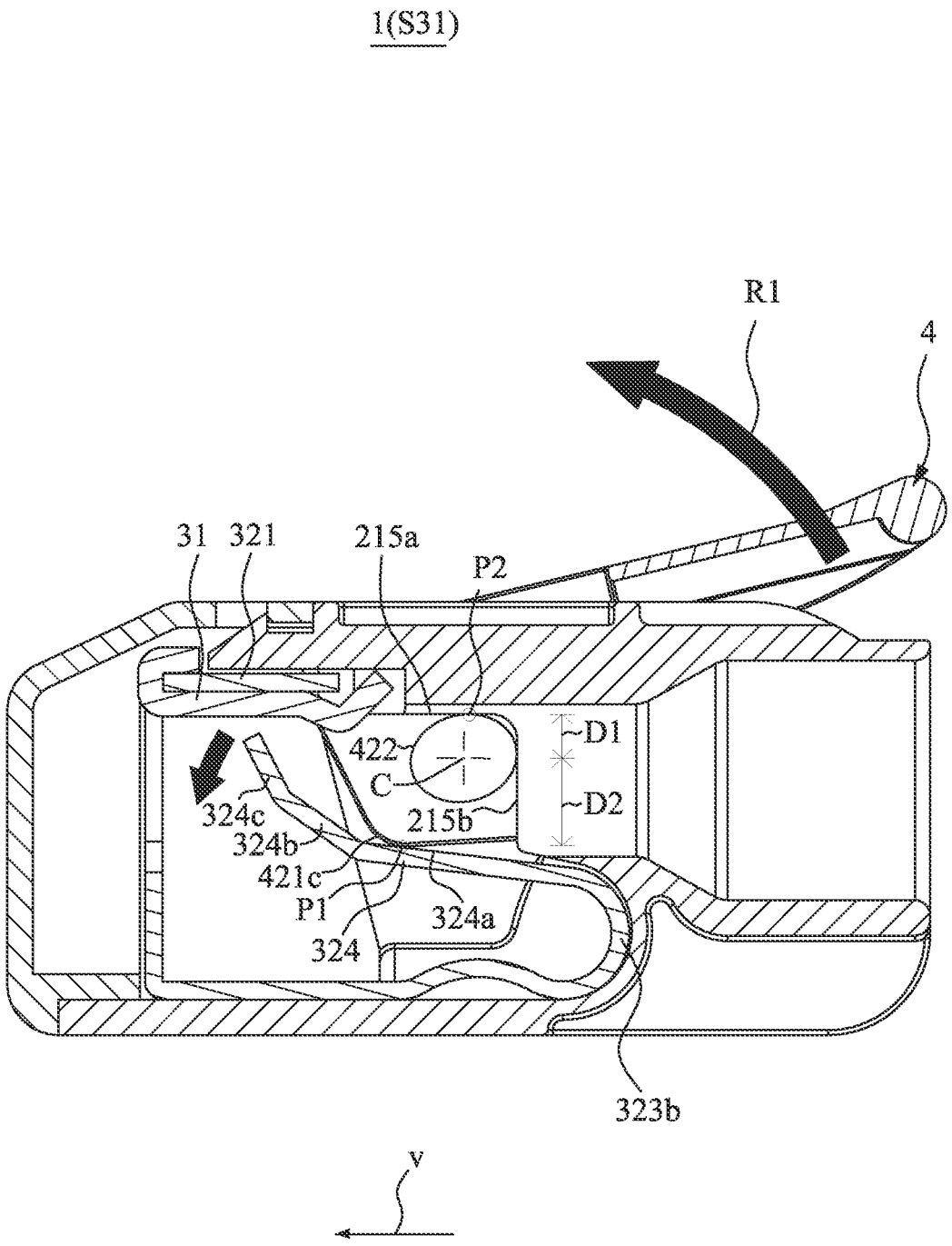
FIG. 5B shows a schematic cross-section of the electrical conductor connector in a first transition status.
Figure 5C:
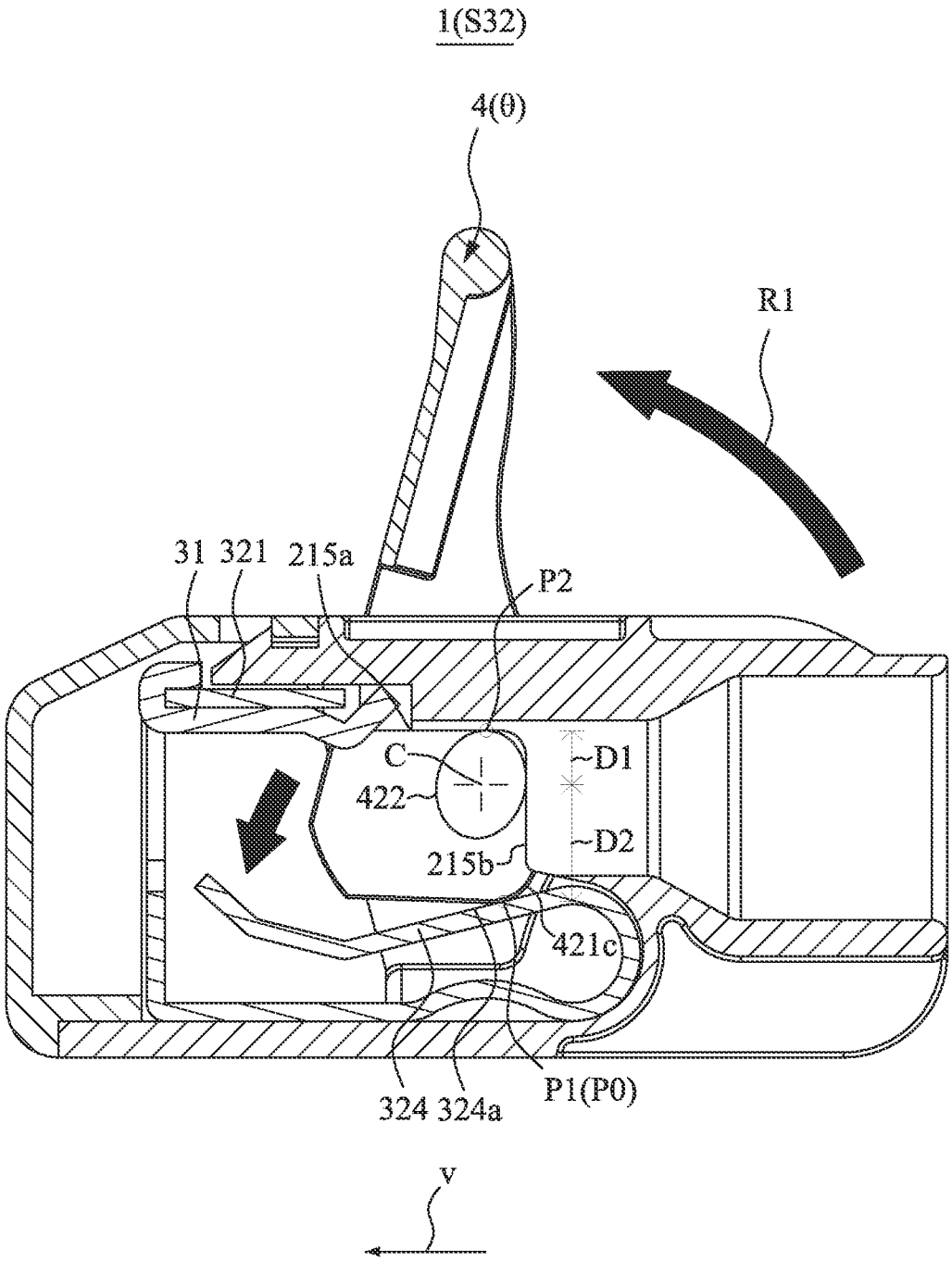
FIG. 5C shows a schematic cross-section of the electrical conductor connector in a second transition status.
Figure 5D:
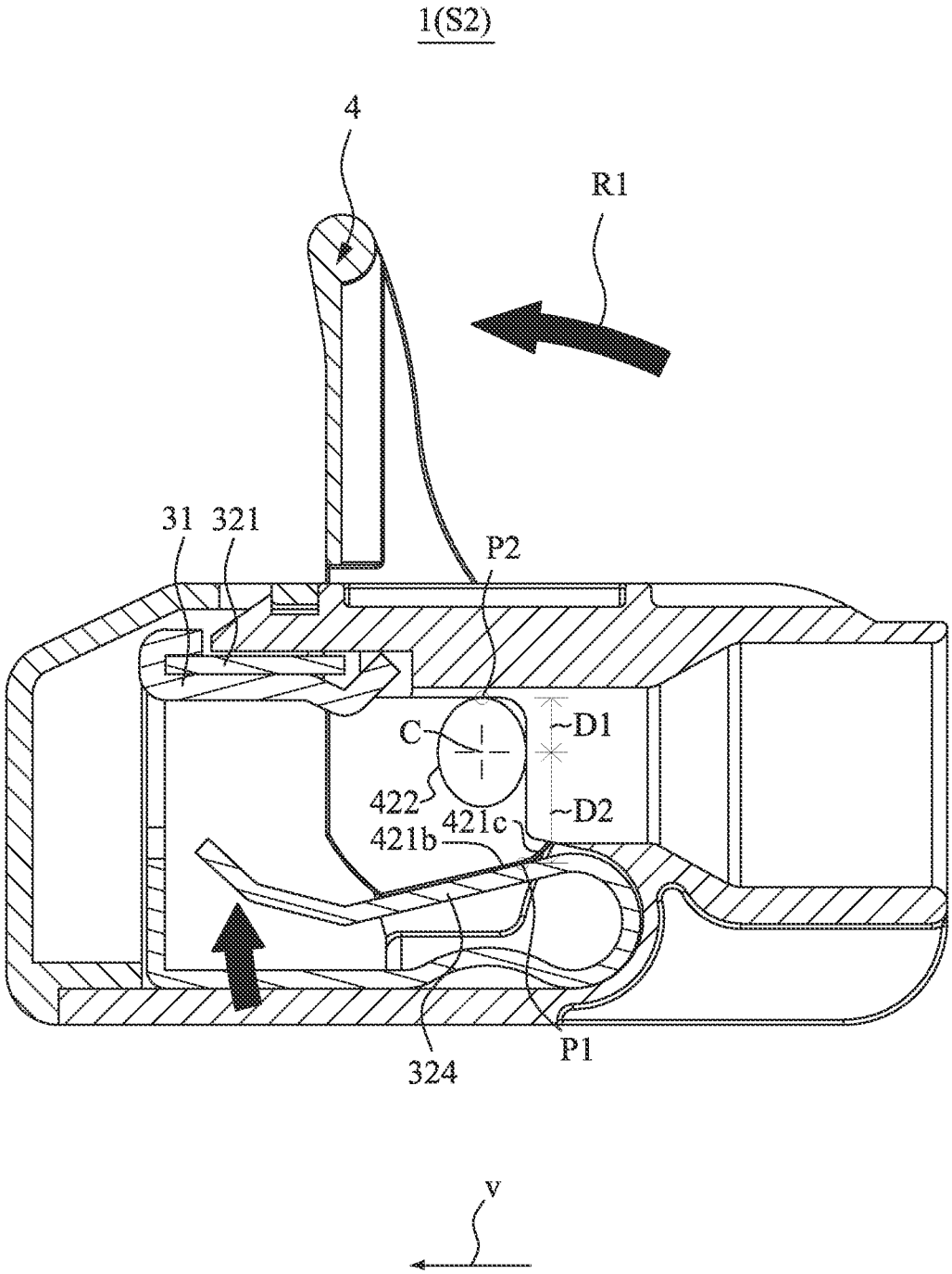
FIG. 5D shows a schematic cross-section of the electrical conductor connector in a release state.

As shown in FIG. 5A and FIG. 5D, in the clamp status S1, the surface of the first plane 421*a* is substantially parallel to the surface of the wire connection clamp 32, and the short axis S of the cam 422 is perpendicular to the stop wall 215. In the release status S2, the surface of the second plane 421*b* is parallel to the surface of the wire connection clamp 32, and the long axis L is perpendicular to the stop wall 215.

Regarding the operation of the electrical conductor connector 1 and the relationship between each structural member, please refer to FIGS. 5A to 5D. In this embodiment, when the electrical conductor connector 1 is kept in the clamp status S1 without clamping the lead wire 23 as shown in FIG. 5A, the grip area 431 is approximately parallel to the inserting direction V, and a first vertical distance D1 between the center point C of the cam 422 and the first contact surface 215*a* is approximately equal to the short axis S.

The first plane 421*a* of the actuation portion 41 is substantially parallel to the compression portion 324*a* of the second clamping arm 324 in the clamp status S1 (see FIG. 5A). However, as the user operates the actuation lever 4, the first vertical distance D1 will gradually increase and become larger than the length of the short axis S. The actuation lever 4 will form a contact point P1 on the actuation portion 41 at an initial position (the position where the compression portion 324 is first touched) for contacting the compression portion 324. A second vertical distance D2 is formed between the contact point P1 and the center point C (see FIG. 5B). The actuation lever 4 is subjected to a force from the second clamping arm 324, causing the cam 422 to contact both the first contact surface 215*a* and the second contact surface 215*b* of the stop wall 215. As shown in the figure, the contact point P1 is located to the left of the center point C along the inserting direction V.

When the user flips the actuation lever 4 to change the electrical conductor connector 1 from the clamp status S1 (see FIG. 5A) to a first transition status S31 (see FIG. 5B), the actuation lever 4 is rotated in the counterclockwise direction as shown by the arrow R1 in FIG. 5B, and the cam 422 will rotate with the actuation lever 4 to push against the second clamping arm 324 for resisting a restoring force generated by the deformation of the elastic arm 323. In the process, the cam 422 is subjected to the restoring force so that the cam 422 still contacts both the first contact surface 215*a* and the second contact surface 215*b* of the stop wall 215. The cam 42 will slide and rotate simultaneously on the first contact surface 215*a* and the second contact surface 215*b*, so that the contact point P1 moves to the right on the compression portion 324*a*.

Comparing FIG. 5A and FIG. 5B, it can be seen that in such a process, since the cam 422 is still in contact with the first contact surface 215*a* and the second contact surface 215*b* respectively, the position of the center point C will be influenced by the contour of the cam 422 for moving along the inserting direction V and the direction perpendicular to the inserting direction V synchronously, and the first vertical distance D1 between the center point C of the cam 422 and the first contact surface 215*a* is continuously increased. During the process, the second vertical distance D2 is continuously increased by rotating the actuation portion 41 of the actuation lever 4. At the same time, the second clamping arm 324 is swung, so that the spacing between the second clamping arm 324 and the first clamping arm 321 (busbar 31) gradually increases. The contact point P1 will gradually move from the first plane 421*a* to the curve surface 421*c*.

As shown in FIG. 5A to FIG. 5C, when the actuation lever 4 continues to rotate, the contact point P1 will move to the curve surface 421*c*, the first vertical distance D1 between the center point C and the first contact surface 215*a* will continue to increase due to the contour of the cam 422, and the second vertical distance D2 between the contact point P1 and the center point C will also increase as the shape of the pressing section 421 changes. By increasing the first vertical distance D1 and the second vertical distance D2, the swing distance of the second clamping arm 324 is further increased, when the second clamping arm 324 is pushed by the pressing section 421. The present invention is different from other conventional art that use a fixed axis of rotation, because the center position of rotation does not change with respect to the outer shell).

As shown in FIG. 4B and FIG. 5A to FIG. 5C, the first vertical distance D1 and the distance between clamping the second clamping arm 324 and the first clamping arm 321 are continuously increased during the contact point P1 on the curve surface 421*c* continues to move from one end near the first plane 421 to the other end near the second plane 421*b*.

As shown in FIG. 5C, when the actuation lever 4 is rotated to an angle θ, the second vertical distance D2 reaches the maximum state as shown in FIG. 5C due to the shape of the pressing section 421. Then, the second vertical distance D2 and the distance between the second clamping arm 324 and the first clamping arm 321 will gradually decrease, and the increment rate of the first vertical distance D1 will also be gradually reduced (but the length of the first vertical distance D1 is still increasing). Therefore, the electrical conductor connector 1 is in a second transition status S32 during the variation of the total distance (D1+D2). The contact point P1 is moved from the left side of the action point P2 to the right side of the action point P2 through the below position of the action point P1, and an extreme position P0 is located in the right side of the action point P2.

Referring to FIG. 5C and FIG. 5D, when the actuation lever 4 continues to rotate to a maximum angle as shown in FIG. 5D (limited by the block surface 221*b* of the second body 22), the first vertical distance D1 will be maximized equal to the length of the long axis L of the cam 422, and thus the second vertical distance D2 in FIG. 5D will be smaller than the second vertical distance D2 in FIG. 5C, so that the second clamping arm 324 will rotate in the clockwise direction as shown in the figure and form an opening between the second clamping arm 324 and the busbar 31 for the lead wire 23 to enter.

Figure 5E:
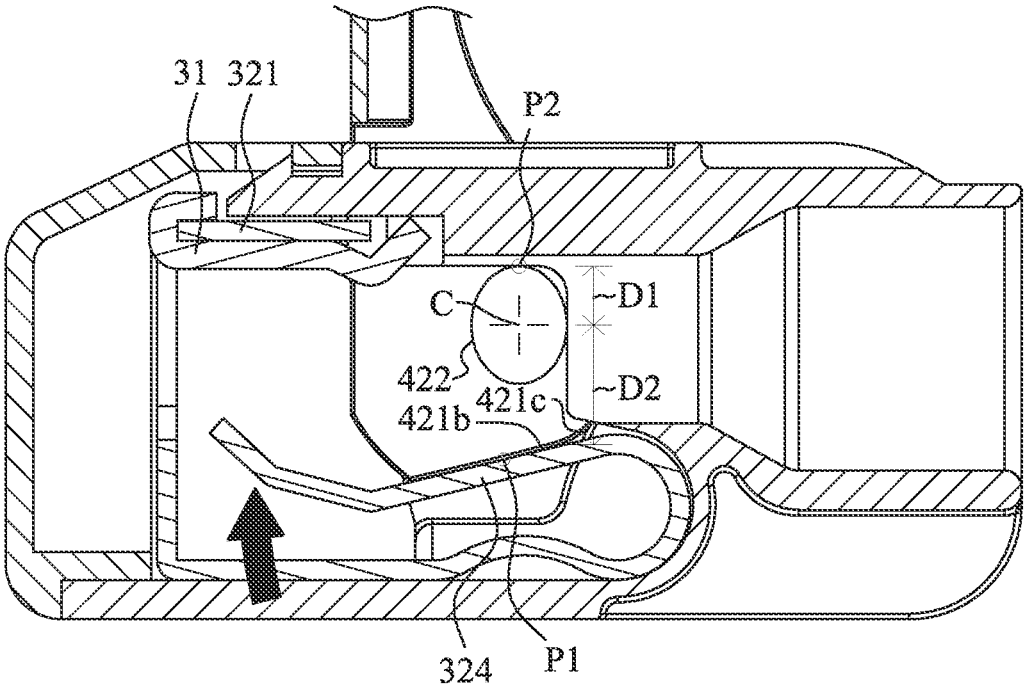
FIG. 5E is a cross-sectional view of the electrical conductor connector forming a different contact point in the release status.
Figure 5F:
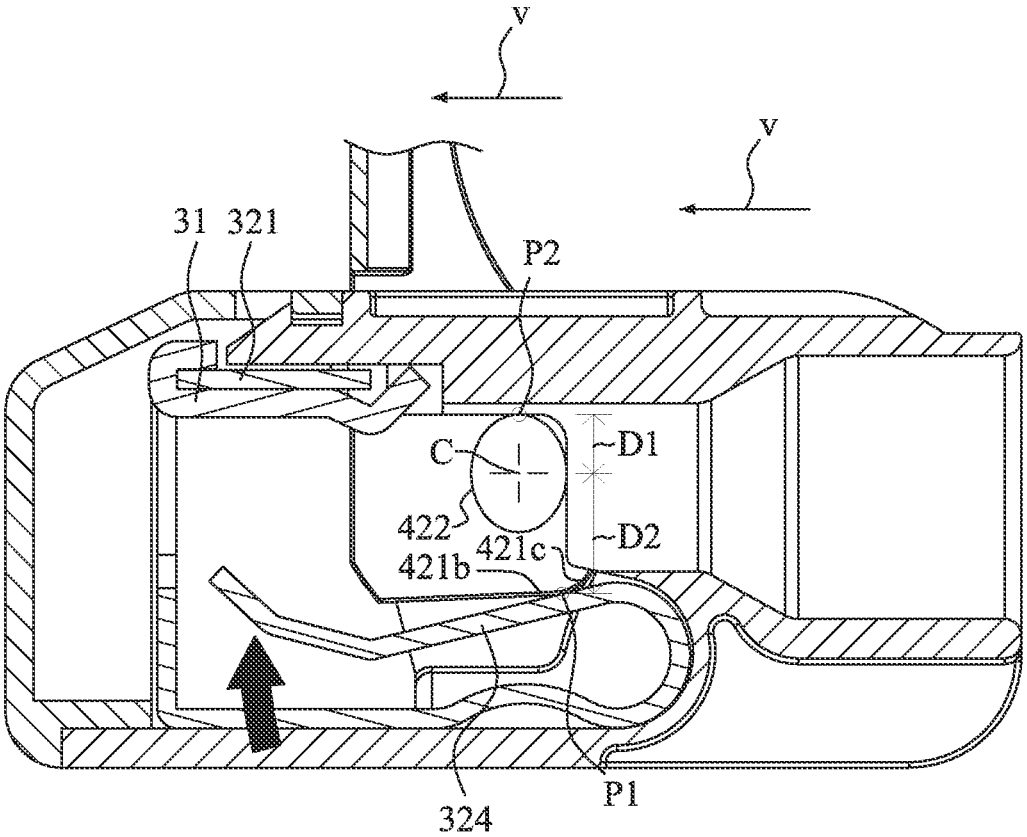
FIG. 5F is a cross-sectional view of the electrical conductor connector in another embodiment in the release status.

In this embodiment, the angle of the second plane 421*b* is designed so that the second plane 421*b* is in surface contact with the second clamping arm 324. However, in particular, the present invention does not limit the angle of the second plane 421*b*, so in other embodiments, a foldback point is generated in the movement trace of the contact point P1, and the contact point P1 can be moved to the left side of the foldback point by changing the curvature of the curve surface 421*c* (without changing the position, angle and shape of the cam 422) as shown in FIG. 5E. Or the contact point P1 can be moved to a terminal point by changing the shape of the second contact surface 215*b* (the position shown in FIG. 5F).

Figure 5G:
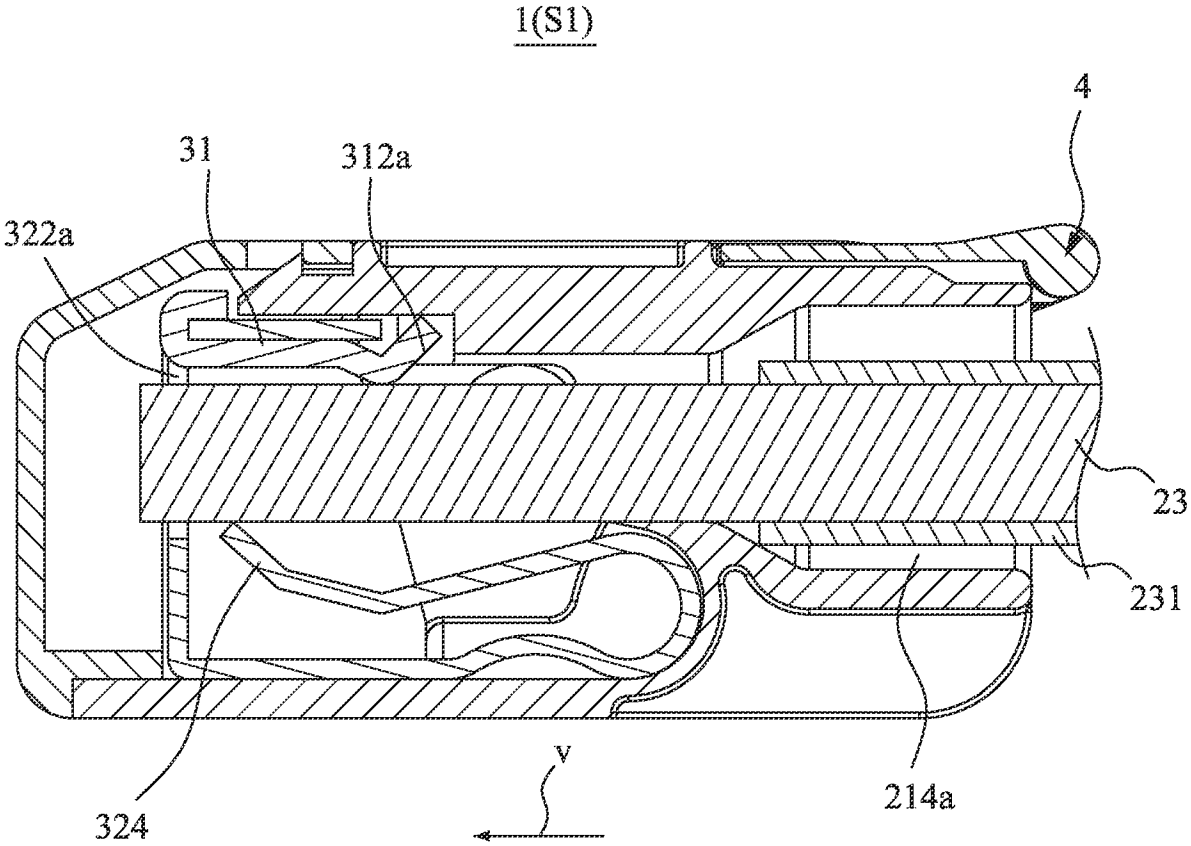
FIG. 5G is a cross-sectional view of the clamp status of the electrical conductor connector and the lead wire.

When the lead wire 23 is to be fixed, the second clamping arm 324 is brought closer to the busbar 31 by rotating the lever 4 in the opposite direction, and the lead wire 23 is clamped in the mounting space 213 (as shown in FIG. 5G).

As can be seen from the above description, when operating the electrical conductor connector 1, the user must first apply a gradually increasing force to make the actuation lever 4 resist the elasticity of the elastic arm 323 and bring the second clamping arm 324 to start swinging (as shown in FIG. 5A to FIG. 5D). Once the user lets the actuation lever 4 go in this process, the elastic arm 323 of the contact member 3 will return to the original position due to the elasticity.

When the user continues to rotate the actuation lever 4, the contact point P1 moves toward this second plane 421*b* (FIG. 5A to FIG. 5C), the first vertical distance D1 is influenced by the contour of the cam 422 for increasing continuously in the process, so that the distance between the first clamping arm 321 and the second clamping arm 324 becomes larger and larger, and when the angle is reached 0, the swinging angle of the second clamping arm 324, and a maximum opening is created between the first clamping arm 321 and the second clamping arm 324.

Finally, the contact point P1 leaves the curve surface 421*c*, the second vertical distance D2 will begin to shorten and slightly offset the increment rate of the first vertical distance D1, bringing the first clamping arm 321 and the second clamping arm 324 closer to each other. The distance between the cam 422 and the first contact surface 215*a* is equal to the length of the long axis L.

In present invention, the shape of the pressing section 421 is not limited to the first plane 421*a* and the second plane 421*b*; for example, the contour of the pressing section 421 may be directly formed as a curve surface.

What is claimed is:

1. An electrical conductor connector, comprising:

an insulating body, being formed with a plurality of inserting openings along an inserting direction, a mounting space being formed inside the insulating body for communicating with the inserting openings, along which a plurality of lead wires are respectively insertable into the mounting space;

a contact member, being located in the mounting space and being constructed with multiple terminal contacts adjacent to each other, the contact member including a busbar forming the terminal contacts, and a wire connection clamp for pressing the lead wires inserted therein against the busbar; and an actuation lever, being movably assembled to the insulating body and having an actuation portion operating the wire connection clamp, and a flip portion forming a grip area, the actuation portion having two operation boards symmetrically arranged to form a spacing area, an edge contour of each of the operation boards being constructed with a pressing section against the wire connection clamp, the pressing section having a first plane, a second plane, and a curve surface located between the first plane and the second plane, wherein each of the operation boards is provided with a cam, and a stop wall is formed in the mounting space for contacting the cams;

the actuation lever is so configured that, when the flip portion is flipped, the wire connection clamp is changed from a clamp status for holding the lead wires to a release status for allowing the lead wires to enter the inserting openings, to thereby swing the actuation lever to move along at least one contact surface of the stop wall by contours of the cams, such that a relative displacement is generated between the insulating body and the actuation lever, and a contact point between the wire connection clamp and each of the pressing sections continuously change from the first plane, through the curve surface, to the second plane of said each pressing section, wherein the first plane and the second plane of each of the pressing sections are in surface contact with the wire connection clamp.

2. The electrical conductor connector as claimed in claim 1, wherein the at least one contact surface of the stop wall comprises a first contact surface and a second contact surface that is adjacent to the first contact surface; and a force is generated by the wire connection clamp to push the cams, so that the cams keep in contact with both the first contact surface and the second contact surface.

3. The electrical conductor connector as claimed in claim 2, wherein when the flip portion is flipped, the pressing sections press against the wire connection clamp, to thereby swing the actuation lever to keep the cams contacting the first contact surface and the second contact surface.

4. The electrical conductor connector as claimed in claim 1, wherein each of the cams has a center point, a long axis and a short axis, the long axis and the short axis pass through the center point; the surface of the second plane is parallel to the surface of the wire connection clamp in the release status, and the long axis is perpendicular to the stop wall.

5. The electrical conductor connector as claimed in claim 4, wherein the wire connection clamp may be swung for clamping one of the lead wires, when the electrical conductor connector is changed from the clamp status to the release status, the distance between the center point and the stop wall continues to increase, so that the wire connection clamp is push by the pressing section to increase a swing distance of the wire connection clamp.

6. The electrical conductor connector as claimed in claim 4, wherein a first vertical distance is formed between the center point and the stop wall, a second vertical distance is formed between the center point and the contact point, when the electrical conductor connector changes from the clamp status to the release status, the first vertical distance continues to increase, and the second vertical distance first gradually increases and then gradually decreases after the actuation lever exceeds a rotation angle.

7. The electrical conductor connector as claimed in claim 1, wherein the wire connection clamp comprises a first clamping arm, a positioning wall, an elastic arm, a second clamping arm and a limit arm, the busbar is attached with the first clamping arm, the positioning wall is provided with at least one perforation for a lead wire entry and is connected to the first clamping arm, the elastic arm is connected to the positioning wall and a spacing is formed between the elastic arm and the first clamping arm, the second clamping arm is connected to the elastic arm, the limit arm is connected between the first clamping arm and the elastic arm to limit the length of the space without increase.

8. The electrical conductor connector as claimed in claim 7, wherein the second clamping arm comprises a compression portion, a first line section and a second line section, the first line section is extended with the compression portion toward the first clamping arm, the second line section is extended with the first line section, and the opposite sides of the compression portion are provided with a lug for aligning the position of the pressing section.

9. The electrical conductor connector as claimed in claim 7, wherein the elastic arm comprises a first curved section and a second curved section extending from the first curved section, the second curved section is folded for connecting the second clamping arm.

* * * * *